US005626035A

United States Patent [19]

Pozvonkov

[11] Patent Number: 5,626,035

[45] Date of Patent: May 6, 1997

[54] APPARATUS AND METHOD FOR SEPARATION OF HELIUM AND NEON

[75] Inventor: Felix Pozvonkov, Moscow, Russian Federation

[73] Assignee: Russian American Technology Alliance, Norcross, Ga.

[21] Appl. No.: 506,218

[22] Filed: Jul. 24, 1995

[51] Int. Cl.[6] ..... F25J 5/00

[52] U.S. Cl. ..... 62/637; 62/639; 62/923

[58] Field of Search ..... 62/637, 639, 923

[56] References Cited

U.S. PATENT DOCUMENTS 3,609,984 10/1971 Garwin ..... 62/923
3,854,913 12/1974 Leyarovski et al. ..... 62/923
3,854,914 12/1974 Leyarovski et al. ..... 62/923
4,755,201 7/1988 Eschwey et al. ..... 62/637
5,100,446 3/1992 Wisz ..... 62/923

*Primary Examiner*—Ronald C. Capossela
*Attorney, Agent, or Firm*—Kilpatrick & Cody

[57] ABSTRACT

An apparatus and method for the cryogenic purification of gaseous mixtures is provided. The apparatus comprises a heat-insulated hermetically sealed vessel which contains liquid hydrogen. Immersed within the liquid hydrogen are a number of serially connected cartridges which contain chips of a thermally conductive mixture. A mixture of neon and helium is input into the apparatus. The neon freezes, while the helium passes through the apparatus in a gaseous state. The resulting neon is allowed to thaw into a liquid or gaseous form and is highly pure.

16 Claims, 1 Drawing Sheet

APPARATUS AND METHOD FOR SEPARATION OF HELIUM AND NEON

FIELD OF THE INVENTION

The invention is in the area of an apparatus and method for the separation of mixtures of gaseous materials. One mixture suitable for separation in the present apparatus is a mixture of neon and helium. This separation provides highly purified neon gas.

BACKGROUND OF THE INVENTION

Liquid neon, with more than 30 times the refrigerant capacity, per unit of volume, of liquid helium, is an economical cryogenic refrigerant. Neon is also used in the manufacture of electrical and electronic equipment, such as lightning arrestors, wave meter tubes, high-voltage indicators, television tubes and lasers.

Currently, there is an increased interest in the use of neon as a coolant. This interest arises from neon's physical properties, including: its low boiling temperature, which allows cooling to temperatures in the range 24°–43° K.; comparatively high gas and liquid density; high latent heat of evaporation; and noncombustibility. In addition, neon's status as an inert gas also provides advantages. All of these properties are similar to the corresponding properties of liquid hydrogen, with the exception of non-combustibility. Liquid hydrogen and hydrogen gas are highly combustible and pose a risk of fire or explosion. The use of liquified neon makes it possible to conduct experiments using temperature regimes similar to those of liquid hydrogen without the risk of explosion or fire.

One problem with the use of neon is that it is usually obtained as a mixture of helium and neon. Conventionally, it has been difficult and impractical to separate the neon and the helium to produce high purity neon on an industrial scale. Current commercial scale processes for the purification of neon from helium on an industrial scale require the use of complicated equipment including heat exchangers, rectification columns, and compressors.

One known apparatus for the separation of neon and helium using liquid hydrogen is disclosed in V. G. Fastovsky, A. E. Rovinsky and U. V. Petrovsky, "Inert Gases." At the boiling point of liquid hydrogen under atmospheric pressure (20.4° K.), pure neon is in a solid state (the temperature of triple point for neon is 25.56° K.) and helium is gaseous. However, when liquid hydrogen is at atmospheric pressure, the neon-helium mixture cannot be cooled below 20.4° K. At that temperature the saturated vapor pressure of neon is 37.3 millimeters of mercury. As a result, there is a noticeable amount of neon impurities in the gaseous fraction, which lowers the quality of mixture separation and reduces the amount of neon recovered from the mixture. Creating a vacuum over the liquid hydrogen can lower its boiling temperature to 14° K., which permits helium recovery with little neon contamination, and also permits the recovery of high purity neon (V. G. Fastovsky, A. E. Rovinsky, and U. V. Petrovsky "Inert Gases").

This apparatus provide a laboratory scale extraction of 0.067 $nm^3$ of pure neon per hour. In this process, 200 liters of liquid hydrogen were required to obtain 1 $nm_3$ of pure neon. This process uses a container cooled from the outside by liquid hydrogen. Because of its design, only a small quantity of neon can be frozen out at any one time. It is then necessary to stop the apparatus after solidifying a small amount of neon and to pump out the gaseous helium which contains a neon impurity. A fresh charge of the neon/helium mixture is then introduced into the vessel and additional neon is solidified. The residual helium and neon is then pumped out of the vessel again. This procedure is repeated until the vessel is completely filled with solid neon. At that time, an electric heater is used to melt and evaporate the neon. O. Tabunchikov et al, "Chem. Petrol. Eng." describes a similar process.

This process suffers from several obvious drawbacks. First, the use of electric heating elements in the presence of highly flammable liquid hydrogen or hydrogen gas is clearly undesirable. In addition, the process is very inefficient, requiring multiple charging and evacuation steps to obtain a small amount of purified neon. It is unsuitable for large-scale commercial application.

Another known apparatus which has been used to separate neon from helium is that described in USSR Inventors Certificate No. 1011144, 1981. This apparatus consists of two coils, provided with two heaters on their lower parts. The coils are located in a cryostat above the surface of the cryogenic liquid. For cooling purposes, each coil is in a shell which covers it from bottom to top. The coils are interconnected by pipes, with switch valves that permit transmission of the condensed mixture from the bottom of one coil to the top of the other.

This apparatus has several drawbacks which preclude its use in the large scale separation of neon from helium. First, the mixture which is introduced into this apparatus should have a solidification temperature (solid state phase transition/pass) which is higher than the boiling point of the cryogenic liquid that is in the cryostat. Thus, this apparatus can be used for the purification of neon from admixtures with solidification temperatures which are higher than liquid hydrogen's boiling temperature. However, this will not be effective for a neon-helium mixture, using liquid hydrogen as the cryogenic agent, as helium can not be condensed in such an apparatus.

It would be desirable to provide an apparatus and method for the separation of helium from neon which did not require continual cessation of the process to remove the helium from the container and which did not use electrical heating elements. It would also be desirable to provide an apparatus which would allow the simplified isolation of neon from helium on an industrial scale.

One object of the present invention is to provide an apparatus for the separation of neon and helium which produces highly purified neon on an industrial scale at an economical cost.

Another object of the present invention is to provide an efficient method for the production of purified neon, on large scale with high productivity and reliability.

SUMMARY OF THE INVENTION

The present invention provides an apparatus and method for the cryogenic separation of mixtures of materials which are gaseous at room temperature. One example of materials which can be separated using this apparatus and method is a mixture of neon and helium.

The apparatus comprises a heat-insulated hermetically sealed vessel which contains a cryogenic coolant. Immersed within the cryogenic coolant are a plurality of serially connected cartridges which have a hollow cavity. The mixture to be purified is introduced into the first of these cartridges. The cartridges are connected together by branch piping which allows gas transfer therebetween and have collection piping for the removal of the purified material at the end of the process. For optimum results, the hollow cavity of the cartridge is filled with chips of a heat conductive material.

In the present method, a mixture of materials which are gaseous at room temperature is introduced into the hollow cavity of the first cartridge. A cryogenic coolant is introduced into the cryostat in an amount sufficient to submerge the cartridges. The cryogenic coolant should be selected such that one component of the mixture is a solid at the coolant's temperature, while the remaining components of the mixture remain gaseous. A portion of the material to be purified solidifies in the first cartridge. The remainder of the mixture, passes through connection piping to the second cartridge, where an additional portion of the material to be purified is solidified. This procedure is repeated as the mixture passes through the remaining cartridges in the cryostat. At the end of the process, the mixture is passed out of the cryostat and is either collected or can be vented into the atmosphere.

The process is complete when one or more of the cartridges are completely full of the solidified material. At that point, the cryogenic coolant is removed, a heating gas is introduced into the cryostat, and the material to be purified is collected in gaseous or liquid form.

DETAILED DESCRIPTION OF THE INVENTION

I. The Apparatus

The present apparatus is used to purify mixtures of materials which are gaseous at room temperature. This separation is accomplished by the exposure the mixture to a temperature at which one component of the mixture (the component to be purified) is a solid, while the other component remains in a gaseous state.

A preferred use of the present apparatus is as the main component of a neon-helium separation unit which uses liquid hydrogen as the cryogenic coolant.

Figure 1:
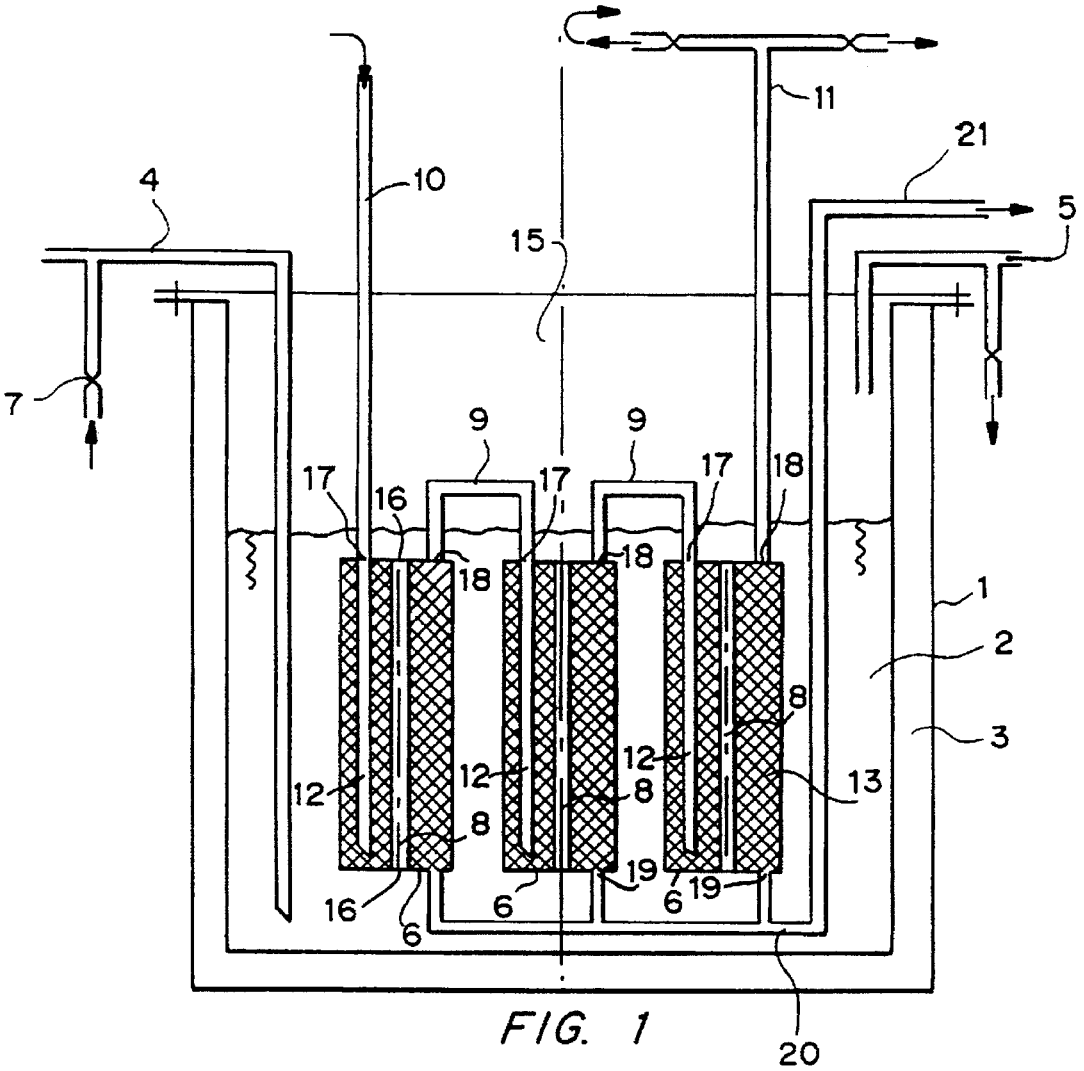
FIG. 1 shows an example of the structure of apparatus of the present invention.

The basic structure of the present apparatus is shown in FIG. 1. The apparatus comprises a cryostat 1 which contains a plurality of serially connected cartridges 6. The cryostat 1 is insulated, so as to minimize heat exchange between the interior of the cryostat 1 and the outside environment. This insulation can be provided using a wall with a hollow space or cavity 3 which contains a vacuum or vacuum with multi-layer insulation or other forms of insulation. Alternatively, the hollow of cryostat 1 can be surrounded by another cryogenic coolant, such as liquid nitrogen.

Cryostat 1 is equipped with inlet means, such as feed piping 4, for the introduction of a cryogenic coolant into the cryostat 1 and return piping 5 for withdrawal of vapor from the interior of the cryostat 1.

Separation of the mixture occurs through the use of hermetically sealed cartridges 6 which are placed within the cryostat/separator. Any number of cartridges can be used which provides efficient separation of the desired mixture. FIG. 1 is representative and shows three cartridges connected in series.

For mixtures of helium and neon, it is preferred that seven cartridges are used in the present apparatus. If more than seven cartridges are used, the total number of cartridges is preferably a multiple of seven. In addition, FIG. 1 only shows a single series of cartridges. In a suitably large cryostat, multiple series of cartridges can be run in parallel to provide even greater neon output. In that case, each of these series each preferably contain seven sequentially connected cartridges which are interconnected as shown in FIG. 1.

Figure 2:
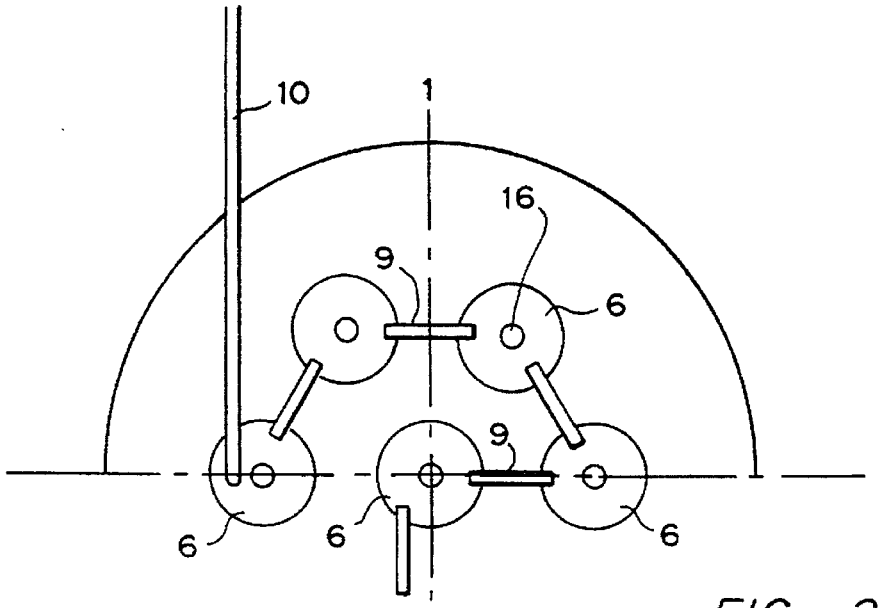
FIG. 2 shows an arrangement of the freezer cartridges in the present apparatus.

The cartridges can be serially connected in a straight line. Alternatively, they can be connected in a circular manner, as shown in FIG. 2. The physical arrangement of the cartridges in the cryostat is not critical, so long as they are serially connected to one another.

The cartridge can be of any desired shape, as long as it is hollow and can be submerged in the cryogenic coolant. The cartridge should volume in the hollow space so that it will not be blocked by frozen material before the cartridge is full. Examples of suitable shapes include the shape of a cube, cylinder, sphere, or elongated box. Preferably, the cartridges are cylindrical. When the cartridges are cylindrical, they are preferably oriented along their vertical (elongated) axes, as shown in FIG. 1.

In the top and bottom surface of each cartridge, there are a number of openings. The top surface of the cartridge contains at least two openings, 17 and 18. The bottom surface of the cartridge contains at least one opening 19.

Preferably, the cartridge contains a additional pair of openings 16, one on the top and bottom surface of the cartridge. These holes are connected to a tube 8 which runs through the cartridge. This structure allows circulation of the cryogenic coolant through the center of the cartridge and provides an increased heat exchange surface area in the hollow cavity 13 of the cartridge. Preferably, the cartridge has a single tube 8 for coolant circulation. However, if desired, a cartridge may have multiple tubes 8 to further increase the heat exchange surface area in the hollow cavity.

The cartridges have a hollow cavity 13 in their interior. The cavities 13 of the cartridges 6 are preferably filled with chips made of material with high thermal conductivity coefficient. Non-limiting examples of suitable chips with high thermal conductivity include aluminum chips and copper chips. These chips can be obtained from a variety of sources, for example, from ordinary lathe cuttings.

The interior cavity 13 of each cartridge 6 are connected in series with one another by connection means, such as branch pipes 9. One end of branch pipe 9 is attached to the second opening in the top of a cartridge 6 and the other end 12 passes through the first opening in the top surface of the subsequent cartridge 6 into its interior 13. In the first cartridge, the first opening 17 is connected to input pipe 10 which introduces the mixture into the cartridge. In the last cartridge, the second opening 18 is connected to output pipe 11 which expels the remainder of the gas from the cryostat.

The cartridges 6 are placed in the cryostat so that the entire cartridge can be submerged in the cryogenic coolant 2. However, the cartridges should be placed such that the connecting me pipes 9 and the input and output means, pipes 10 and 11 respectively, are substantially located in the vapor space 15 of the cryostat. This prevents blockage of these pipes by the freezing of the gas passing through the pipes. A small part of pipes 9, 10 and 11 may be covered by the cryogenic coolant, in order to completely submerge the cartridges. This overlap should be kept small, in order to avoid plugging the pipes with solid neon. However, a small overlap is acceptable, as there is insufficient heat-exchange surface area to allow the neon to freeze and plug the pipe.

At the conclusion of the process, when one or more of the cartridges are filled with solid neon, residual helium is evacuated from the cryostat 1 to provide high purity neon. This occurs, for example, by applying a vacuum to the input pipe 10 and the output pipe 11.

The liquid hydrogen pipe 4 can also be used to drain the liquid hydrogen from the cryostat 1 at the conclusion of the process when the cartridges are filled with solid neon. The pipe 4 is used to introduce a heating gas into the cryostat, by opening valve 7 and allowing the heating gas to enter the cryostat. Examples of suitable heating gasses include helium and nitrogen.

The purified material can be recovered either in a gaseous state or in a liquid state, and stored as same. If the purified material produced in the cryostat is in liquid form, it is discharged from the bottom of each cartridge 6 via opening 19 and is fed via collection means, such as pipe 20, to collection header 21, which is connected to the user or to an apparatus for collecting the purified material for storage and later use. If the purified material is collected in a gaseous state, it is discharged from the top of the cryostat via pipe 11. When the neon is collected in a gaseous state, it is under pressure, and accordingly, can be collected in bottles without the need for further compression.

II. Method for Separation of Gaseous Mixtures

The present invention also provides a method for the separation of gaseous mixtures using the present apparatus. This method is exemplified herein by a method for separating helium and neon, using liquid hydrogen as the cryogenic coolant. However, those skilled in the art will recognize that this method can also be used to separate other gaseous mixtures by appropriate selection of the gas mixture and cryogenic coolant, such that the solidification point of the one of the gases in the mixture is below the temperature of the cryogenic coolant, and the solidification point of the remaining gases in the mixture is above the temperature of the cryogenic coolant. For example, natural gas and helium can be separated in the present apparatus using liquid nitrogen as the cryogenic cooling gas.

Preferably, the input gas mixture is a mixture of neon and helium mixture. One source of such a mixture is from a neon-helium-nitrogen mixture which is a byproduct of conventional air separation plants. The nitrogen is separated from the neon/helium mixture through the use of known methods. One such method uses a reflux condenser and an absorber with activated carbon as disclosed by V. G. Fastovsky, A. E. Rovinsky, U. V. Petrosvsky "Inert gases", Atouizdat, 1972, pp 168.

For the purification of neon, the neon/helium mixture is fed into pipeline 10 of the present apparatus, the end of which terminates in cavity 13 of the first cartridge 6 in the cryostat/separator. The neon/helium mixture should be introduced at a pressure in the range from about 1 to 15 atmospheres, preferably 10 to 15 atmospheres. The neon/helium mixture should have a temperature of 25° to 300° K. when introduced to the cryostat. One way of providing the neon/helium mixture at the desired temperature is to pass it through a heat exchanger, prior to introduction of the gas mixture into pipe 10. Preferably, the neon/helium mixture should be at a temperature in the range 65° to 85° K. when introduced to the cartridge, as this will reduce the amount of liquid hydrogen needed in the cryostat. One common neon/helium mixture temperature is 80° K., as this is typically the output temperature of this mixture in an air separation plant.

The helium/neon mixture can contain any ratio of neon to helium. However, for enhanced separation and isolation of neon, the gaseous mixture is preferably greater than 50 percent neon, with the balance being helium. One preferred mixture for use in this method is a mixture which contains about 75 percent neon and about 25 percent helium.

once gas flow is commenced, liquid hydrogen 2 is added to the cryostat through inlet pipe 4. Preferably, the liquid hydrogen is added at a pressure of 1 to 1.5 atms. The cryostat can be operated at atmospheric pressure or at less than atmospheric pressure, such as under a partial vacuum in vapor space 15. The cryostat can be operated under a normal atmosphere, or an inert atmosphere, such as nitrogen or helium. A sufficient amount of liquid hydrogen is introduced into the cryostat so as to completely submerge the cartridges 6 while leaving a vapor space for the branch pipes 9. The liquid hydrogen should be maintained at that level throughout the process. This level can be maintained using conventional equipment.

The neon condenses and solidifies in the cavity of the first cartridge 6 while the helium, which still contains some neon, exits the first cartridge 6 via branch pipe 9. Because the branch pipe 9 is primarily located in vapor space 15, little or no condensation of neon takes place therein and clogging of the branch pipes 9 with solid neon is avoided. The helium, which still contains neon, passes via branch pipe 9 into the second cartridge where additional neon is condensed and solidified. The helium mixture passes out of the second cartridge 6 into the third cartridge and the process is repeated.

This process is repeated as the gaseous mixture passes through the subsequent cartridges 6 in the series. The neon content in the helium gas stream is substantially reduced by this sequential condensation of neon from the gas stream. The helium and any remaining non-condensed neon, are ultimately discharged into a gas holder via pipe 11.

The effectiveness and productivity of the neon condensation in the present method is enhanced through by filling the cavities 13 of cartridges 6 with chips of material with high thermal conductivity coefficient. The heat exchange efficiency of the cartridge 6 is also enhanced by tube 8, the cavity of which is connected to the liquid hydrogen reservoir and accordingly, tube 8 is filled with liquid hydrogen.

The condensation of neon using this method provides high neon recovery from gaseous mixture. The point of completion of this process is determined when the gas flow is completely blocked by the build up of solid neon in the cartridges. At that point, the feeding of the neon/helium gas mixture into the cryostat is stopped. At this stage, any residual helium gas is evacuated from the cartridges by applying a vacuum to pipe 11. The liquid hydrogen 2 is then withdrawn from the cryostat via inlet pipe 4. The cryostat is preferably flushed with a small amount of helium gas to remove any residual hydrogen.

After flushing is complete, a heating gas is introduced into the cryostat. The heating gas may be at any suitable temperature to warm the cartridges 6. Preferably, however, the heating gas is at a temperature of 300° C. Suitable heating gases include nitrogen and helium.

The application of heating gas melts the solid neon and either liquifies it or vaporizes it, depending on the desired output state for the neon. If liquid neon is desired, the cryostat should be heated to a temperature of 28° to 30° K. and the liquid neon should be withdrawn from the cryostat via pipeline 21. If gaseous neon is desired, the cryostat should be warmed to a temperature of about 80° K. The gaseous neon passes via pipelines 11 out of the cryostat, where it can be collected under pressure.

After the output is collected, the entire cycle is repeated. If the separator operates continuously, 4 to 7 cycles can generally be achieved in a 24 hour period. A typical neon yield for a single seven-cartridge separator is 200 $m^3$ over a 24 hour period.

The typical purity of the neon produced by the present method is 99.997%. The amount of the impurities are: $CO_2$<0.5 ppm, $H_2O$<1.0 ppm, THC<1.0 ppm, $N_2$<1.0 ppm, He<50 ppm, $O_2$<1.0 ppm, and $H_2$<1.0 ppm.

The energy consumption for production of neon by the present method is 30% lower than through the use of traditional methods for the production of high purity neon. Obviously, energy consumption will be minimized if the present apparatus is used at a plant which is already producing liquid hydrogen and separating air. At these plants, all three components for use in the present apparatus and method will be available on site, the input gas mixture, liquid nitrogen and liquid hydrogen.

Modifications and variations of the present invention will be obvious to those skilled in the art from the foregoing detailed description of the invention. Such modifications and variations are intended to come within the scope of the appended claims.

We claim:

1. An apparatus for the separation of a mixture of materials which are gaseous at room temperature to produce a purified material, said apparatus comprising:

(a) a hollow, sealed, insulated cryostat;

(b) a plurality of serially connected cartridges which are disposed inside the cryostat;

wherein the cartridges have a hollow interior cavity and include at least first, second and third openings, where the first and second openings are located in a top surface of the cartridge and the third opening is located in a bottom surface of the cartridge;

(c) input means for introducing the mixture into the apparatus, said input means introducing the mixture into the hollow interior cavity of a first cartridge;

(d) collection means for collecting the purified material, wherein the collection means are connected to the third opening means located on the bottom surface of each of the cartridges;

(e) inlet means for introducing a cryogenic coolant into the cryostat container, said inlet means introducing the cryogenic coolant to a space inside the cryostat container which is outside the cartridges;

(f) connection means for transferring the mixture between adjacent cartridges, wherein the connection means is connected to the second opening in the top surface of one cartridge and connected to the first opening of an adjacent cartridge; and where the connection means passes through the first opening into the hollow interior cavity of the adjacent cartridge to introduce the mixture into the hollow cavity of the cartridge;

(g) output means for transferring the gaseous mixture from a final cartridge to the exterior of the cryostat.

2. The apparatus of claim 1, wherein the hollow interior cavity of the cartridge is filled with chips of a thermally conductive material.

3. The apparatus of claim 2, wherein the chips are made from a material selected from copper and aluminum.

4. The apparatus of claim 1, wherein the cartridge is in the shape of a cylinder.

5. The apparatus of claim 1, wherein the cartridge has at least one fourth opening in the top surface and at least one corresponding fifth opening in the bottom surface of said cartridge and wherein the fourth opening is connected to the fifth opening in the bottom surface by a hollow tube.

6. The apparatus of claim 5, wherein the cartridge has multiple fourth and fifth openings connected by multiple tubes.

7. The apparatus of claim 1, wherein the insulated cryostat container contains seven serially connected cartridges.

8. The apparatus of claim 1, wherein the cryostat contains additional sets of serially connected cartridges arranged in parallel to the first set of cartridges.

9. A method for the purification of a mixture of materials which are gaseous at room temperature to produce a purified material, comprising:

(a) introducing a gaseous mixture into an apparatus as claimed in claim 1 and passing the gaseous mixture through the serially arranged cartridges while the cartridges are submerged in a cryogenic liquid coolant, until the cartridges are full of a single material which has condensed and solidified;

(b) stopping the introduction of the gaseous mixture into the apparatus;

(c) removing the cryogenic liquid coolant from the cryostat container;

(d) introducing a heating gas into the cryostat container; and (e) collecting the purified material.

10. The method of claim 9, wherein the gaseous mixture is a mixture of helium gas and neon gas.

11. The method of claim 10, wherein the cryogenic liquid coolant is selected from liquid hydrogen and liquid neon.

12. The method of claim 11, wherein the cryogenic liquid coolant is liquid hydrogen.

13. The method of claim 12, wherein the gaseous mixture is a mixture of helium gas and natural gas.

14. The method of claim 13, wherein the cryogenic liquid coolant is liquid nitrogen.

15. The method of claim 9, wherein the purified material is collected as a gas.

16. The method of claim 9, wherein the purified material is collected as a liquid.

* * * * *